US006328059B1

(12) United States Patent
Testori et al.

(10) Patent No.: US 6,328,059 B1
(45) Date of Patent: Dec. 11, 2001

(54) TOP MOUNTED FAUCET ASSEMBLY

(76) Inventors: Alessandro Testori, c/o real S.r.l., Via Olubi, 9/28013 Gattico (Novara) (IT); Scott Brown, 1450 E. Indian School Rd., Suite D, Phoenix, AZ (US) 85014

( * ) Notice: Subject to any disclaimer, the term of this patent is extended or adjusted under 35 U.S.C. 154(b) by 0 days.

(21) Appl. No.: 09/532,911

(22) Filed: Mar. 22, 2000

(51) Int. Cl.[7] ..... E03C 1/04
(52) U.S. Cl. ..... 137/315.12
(58) Field of Search ..... 137/15.17, 315.11, 137/315.1 R, 315.13, 315.41, 359, 360, 801; 4/676, 677, 678, 695; 285/18, 205, 206

(56) References Cited

U.S. PATENT DOCUMENTS

| | | | | |
|---|---|---|---|---|
| 2,848,721 | * | 8/1958 | Fredrickson | 4/676 |
| 4,848,395 | * | 7/1989 | Krippendorf | 137/359 |
| 4,979,538 | * | 12/1990 | Krippendorf et al. | 137/360 |
| 4,998,555 | * | 3/1991 | Barhydt et al. | 137/359 |
| 5,010,922 | * | 4/1991 | Agresta | 137/359 |
| 5,027,851 | * | 7/1991 | Drees et al. | 137/359 |
| 5,224,509 | * | 7/1993 | Tanaka et al. | 137/801 |
| 5,361,431 | * | 11/1994 | Freier et al. | 4/678 |
| 5,558,128 | * | 9/1996 | Pawelzik et al. | 4/677 |
| 5,946,746 | * | 9/1999 | Bloom | 137/801 |
| 6,085,784 | * | 7/2000 | Bloom et al. | 137/801 |

FOREIGN PATENT DOCUMENTS

| | | | | |
|---|---|---|---|---|
| 3513840 A1 | * | 10/1986 | (DE) | 4/677 |
| G8805671.6 | | 4/1988 | (DE) . | |
| 88107677.2 | | 5/1988 | (DE) . | |
| 8815235.9 | | 12/1989 | (DE) . | |

OTHER PUBLICATIONS

Price Pfister, "TwistPfit By Price Pfister," n/a, n/a.
Jonathan Matrin, "American Standard, Inc.," n/a, p. 3.
Rene Steinke, "Masco Corporation," p. 4.
John Simley, "Kohler Company," p.3.
April Dougal Gasbarre, "Moen, Inc.," p.2.

* cited by examiner

*Primary Examiner*—George L. Walton
(74) *Attorney, Agent, or Firm*—Gene Scott-Patent Law & Venture Group

(57) ABSTRACT

A faucet apparatus for mounting on sanitary fixtures such as sinks, washbasins or the like, provides simple and quick installation. The apparatus comprises a block portion inserted into a through hole made in the sanitary fixture and is adapted to protrude with a portion thereof above the sanitary fixture. A couple of passages extend through the block and are adapted to be connected below the sanitary fixture to water intake ducts, and above the sanitary fixture for supplying the faucet. The portion of the block portion protruding above the sanitary fixture is fully housed within the body of the faucet. The apparatus comprises also means for fixing the block portion to the sanitary fixture. The attachment means comprises a fixing member associated with the block and moved from an insertion position in which the fixing member is axially aligned with the hole in the sanitary fixture, and a blocking position in which the fixing member is able to engage the lower surface of the sanitary fixture in which the hole is made.

10 Claims, 3 Drawing Sheets

TOP MOUNTED FAUCET ASSEMBLY

Under the Paris Convention Treaty, the present application claims the priority date of a previously filed Italian utility patent application having an application deposit number MI99U 000166 and an assigned application deposit date of Mar. 22, 1999 and which contains subject matter substantially the same as that described and claimed in the present application. A copy of the filing receipt of the Italian filing is attached hereto and shows, in addition to the above, a reference number: 011826/JVO/pp. The title of the priority document is, "Device for coupling faucets to sanitary fixtures such as sinks, washbasins, bidets, or the like, having a high simplicity of application."

BACKGROUND OF THE INVENTION

1. Field of the Invention

The present invention relates to faucets for sanitary fixtures such as sinks, washbasins, bidets, or the like, and more particularly to such a faucet assembly enabled for mounting the unit strictly from above the mounting surface and for easily and quickly replacing a faucet mixing set portion of the faucet assembly.

2. Description of Related Art

As is known, faucets are generally applied to their respective sanitary fixtures by providing a through hole in a portion of the sanitary fixture where the faucet is to be applied, the base portion of said faucet being inserted into said through hole. In some kinds of faucets, the faucet is fixed to the sanitary fixture by means of a plate that is placed on the lower side of the sanitary fixture and which is meant for engaging the edge of the through hole. The plate is then tightened against the lower face of the sanitary fixture by means of two or more screws which engage with the base portion of the faucet, after it is inserted in the through hole. In other kinds of faucets, the base portion of the faucet protrudes below the through hole and has a screw threading so that it can be engaged by a ring nut. Said ring nut engages the lower face of the sanitary fixture, in the proximity of the edge of the through hole, thus fixing the faucet to the sanitary fixture. The mounting operation of conventional faucets to sanitary fixtures is troublesome in that the fitter must necessarily work under the sanitary fixture where space is cramped and difficult to reach parts necessary to the installation. Particularly in the case of sinks having two compartments, in which the through hole for the application of the faucet is placed at the partition between the two compartments, the mounting operation of the faucet is particularly difficult in that the fitter must operate from the front of the sink whereas the faucet mounting hole is near the rear side between the two compartments which makes the access thereto particularly difficult. In addition, the sanitary fixtures are usually placed resting against a wall, and the hole where the faucet is to be fixed, is proximate to this wall that hinders mounting operations of the faucet. The mounting operations of faucets are also made complicated by the presence of a draining trap or column particularly when the faucet is installed onto a washbasin, as well as by the presence of the wall against which the sanitary fixture rests. In any event, the mounting operation of faucets to sanitary fixtures is an awkward task in that the fitter is compelled to work under the sanitary fixture itself.

In the prior art filed with this application we find several faucet devices as patents relevant to the present application, i.e., Mueller, Schmitt, Farrell et al, McGhee, Botnick, Shieh, Mikol, Tischler et al, Sauter et al, Deutsches Patentamt 8805671 and 8815235, and European 0293655 as well as several articles of reference. The present invention distinguishes over the prior art in its means for mounting, by a single set screw, of a replaceable faucet mixing assembly, onto a fixed-in-place base unit; and by enabling the faucet mixing assembly to be fixed at certain angles left and right of center, and by a top mounting system that allows the base unit to be mounted strictly from above the mounting surface.

SUMMARY OF THE INVENTION

The aim of the invention is therefore to eliminate the above mentioned drawbacks by providing faucets to be connected to sanitary fixtures such as sinks, washbasins, bidets, or the like, without the fitter being compelled to work under said sanitary fixture.

A particular object of the invention is to provide a device that enables faucets to be mounted on sanitary fixtures without requiring that the installer climb or work from under the sanitary fixtures.

Another object of the invention is to provide a device that enables the mounting of both conventional faucets and lever-type mono-control mixing valves and to enable their quick replacement.

A further object of the invention is to provide a device that can be manufactured at extremely low costs and thus will be very price-competitive in the marketplace.

A further object of the invention is to provide a device which enables coupling of faucet assemblies to a wide range of sanitary fixtures, including wash basins, lavabos, bidets, and bathtubs.

A further object of the invention is to provide a device enabled for positioning the faucet water mixing assembly to be positioned at a set angle relative to the sanitary fixture upon which it is mounted.

BRIEF DESCRIPTION OF THE DRAWING

The above mentioned aim and objects as well as others which will become apparent from the following description are achieved by a device for connecting faucets to sanitary fixtures such as sinks, washbasins, bidets, or the like, characterized by comprising a block, a portion of which can be inserted into a through hole made in the sanitary fixture and adapted to protrude with a portion thereof above said sanitary fixture, a couple of passages extending through said block and being adapted to be connected below said sanitary fixture, to a couple of fittings for supplying the faucet, the portion of the block protruding above the sanitary fixture being able to be housed within the body of the faucet; means being provided for fixing said block to the sanitary fixture, said attachment means comprising a fixing member that can be associated to said block and moved from an insertion position in which said fixing member has, transversally of the axis of the hole in the sanitary fixture, a bulk less than the diameter of said hole, to a blocking position in which said fixing member has a bulk greater than the diameter of said hole so as to engage the lower surface of the portion of the sanitary fixture in which the hole is made.

Further characteristics and advantages will be better understood from the following detailed description of a device according to the invention given only by way of example, in the accompanying drawings, in which.

DETAILED DESCRIPTION OF THE INVENTION

Figure 1:
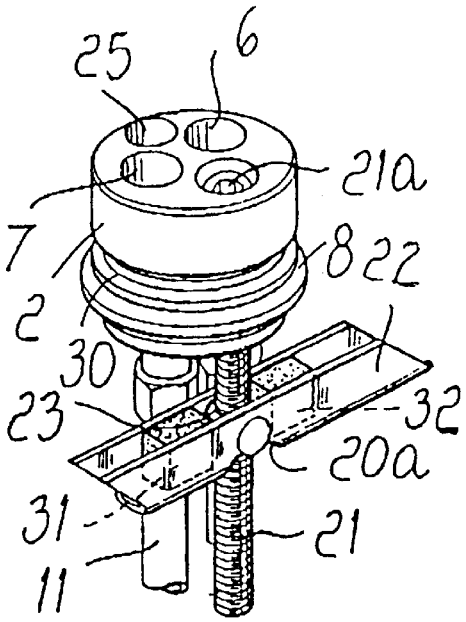
FIG. 1 is a perspective view of a base portion of the apparatus according to the invention.

With reference to the above mentioned FIGS. 1–6, the apparatus comprises a block portion 2, which mounts within a through hole 3 defined in a sanitary fixture 4. Preferably, the sanitary fixture 4 is a sink, washbasin, bidet or the like. An upper portion of the block portion 2 protrudes above the sanitary fixture 4 and can be housed within a lower cavity 51 of the faucet apparatus 5, and is removably fixed thereto.

The block portion 2, preferably of a substantially cylindrical shape, is coupled coaxially in the through hole 3 so as to be aligned with a vertical axis and in a perpendicular attitude to a upper face 4*a* of the sanitary fixture 44.

A relatively narrow portion of the lower base of block portion 2 defines a border 8 and engages the upper face 4*a* of the sanitary fixture 44 at the edge of the through hole 3. A sealing gasket 9*a* is placed therebetween. A protecting and sealing gasket 9*b* is placed below the border 8.

A plurality of passages, preferably a pair of passages 6 and 7, extend vertically through block portion 2, and can be connected below sanitary fixture 4 to a plurality of water intake ducts, preferably a pair of water intake ducts 10 and 11. Preferably, the water intake ducts 10 and 11 provide hot water and cold water respectively, to a plurality of fittings 12 and 13, supplying the faucet apparatus 5 to be mounted to the sanitary fixture 4.

The water intake ducts 10 and 11 are connected to the lower mouths of the passages 6 and 7, preferably by means of a threaded coupling, as shown, or by welding or other known connection techniques.

Cylindrical sealing gaskets 16 and 17 fit tightly around supply fittings 12 and 13. In turn, the cylindrical sealing gaskets 16 and 17 frictionally engage the inside surfaces of the cylindrical passages 6 and 7 .

The supply fittings 12 and 13 protrude upwardly from the block portion 2 and engage, with the interposition of sealing gaskets 14 and 15, the mouth of a supply duct 50 leading into a dispensing portion cavity 51 provided in the dispensing portion 5*a* of the faucet apparatus 5.

An attachment means comprises a fixing member 22 and a threaded screw 21 for fixing the block portion 2 to the sanitary fixture 4. The threaded screw 21 is inserted into a attachment hole 27 that extends axially through the block portion 2.

Figure 3:
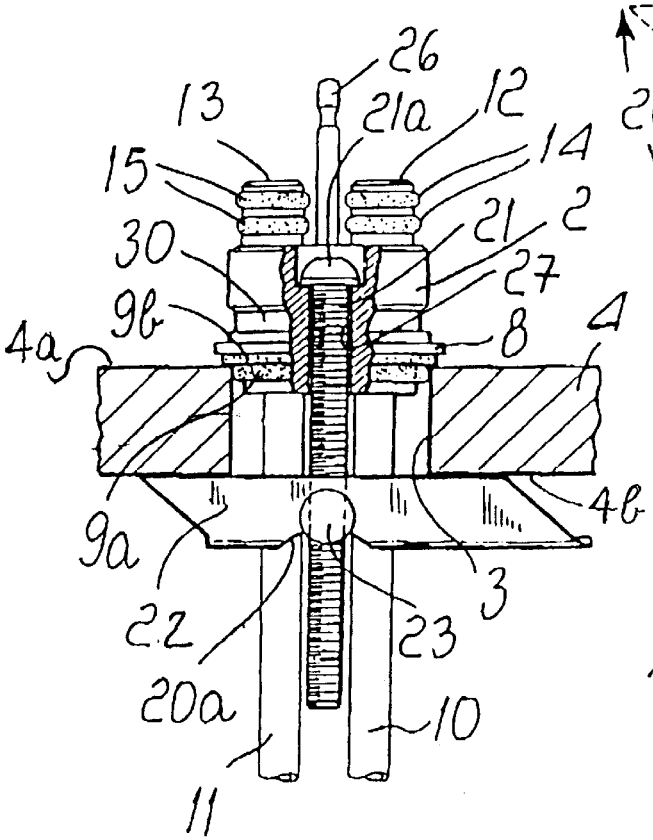
FIG. 3 is a view similar to FIG. 2 shown with a fixing member of the invention in a blocking position and engaged with a lower face of the sanitary fixture.
Figure 4:
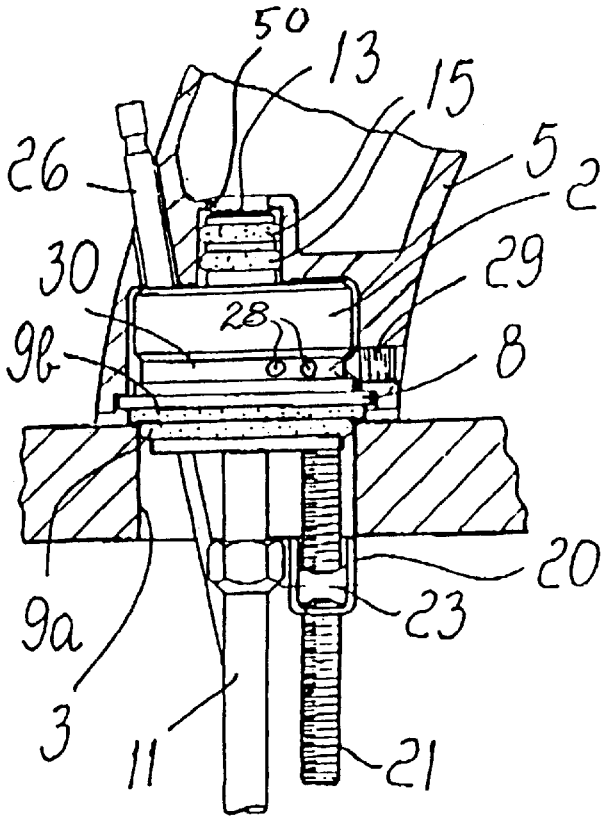
FIG. 4 is a view similar to FIGS. 2 and 3 but at right angles thereto and particularly showing the manner in which a faucet portion is engaged with the base portion of the invention.
Figure 5:
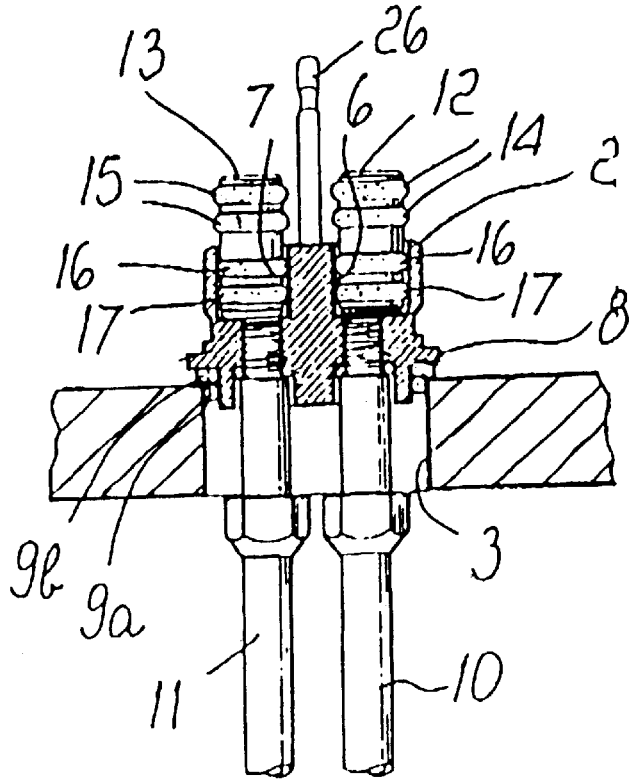
FIG. 5 is a view similar to FIGS. 2 and 3 showing more particularly how water conductors are attached to the base portion of the invention.
Figure 6:
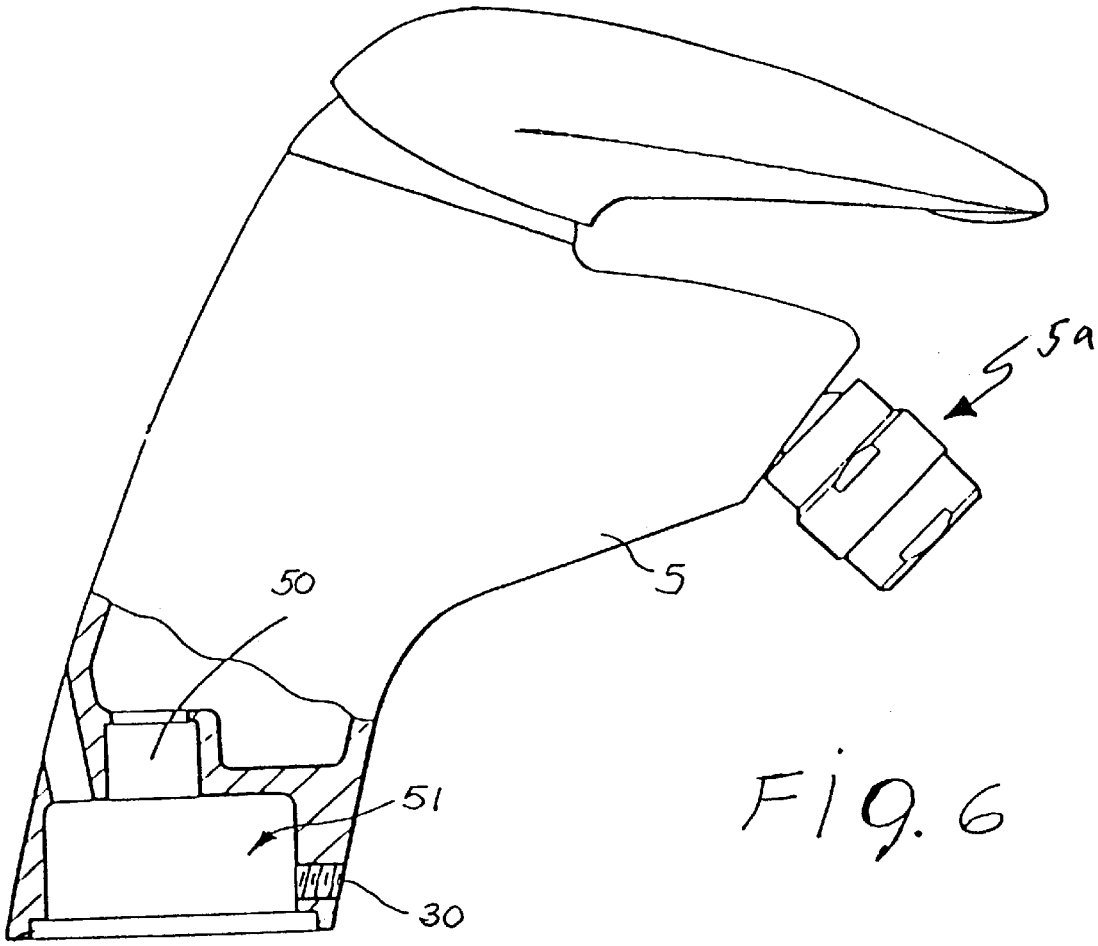
FIG. 6 is a side elevational view of the faucet portion of the invention defining further details thereof.

The fixing member 22 can be associated with the block portion 2 and is movable from an insertion position in which said fixing member 22, when positioned transversally of the vertical axis of the through hole 3, represents a size greater than the diameter of said through hole 3, so as to block withdrawal, as shown in FIG. 3, and in which said fixing member 22, when positioned in line with the vertical axis, has a size less than the diameter of the through hole 3 in order to withdraw the fixing member 22.

More particularly, the attachment hole 27 extends through block portion 2, with a counterbore large enough to house the head 21*a* of the threaded screw 21, and the remainder being a clearance hole for the threaded stem of the threaded screw 21. The threaded stem of the threaded screw 21 terminates in an engagement with threaded hole 60 in pin 23.

Figure 2:
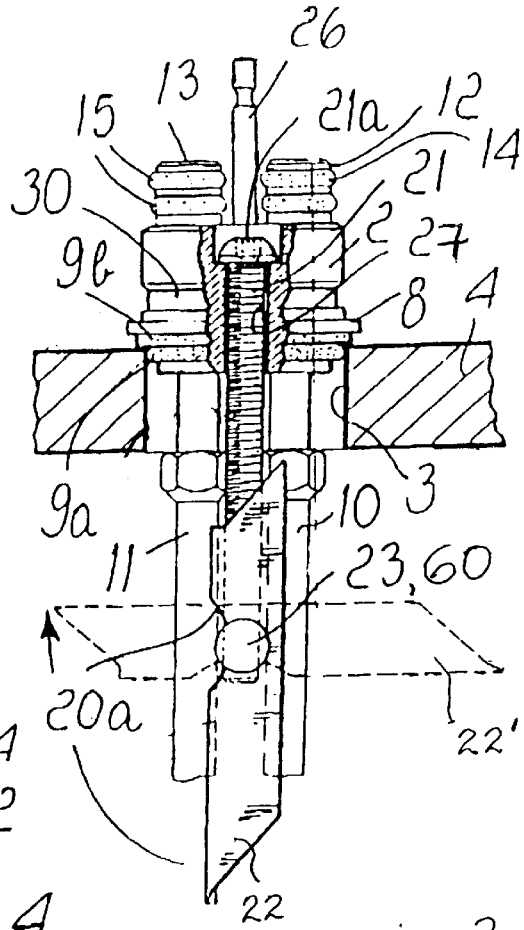
FIG. 2 is a side elevational view, partly in section, thereof shown inserted within a sanitary fixture.

The fixing member 22 is pivotal to pin 23, passing from the insertion position as shown in FIG. 2, to the blocking position 22'in dashed line in FIG. 2 and as shown in FIG. 3. In the blocking position 22', the fixing member 22 can be engaged with the lower face 4*b* of the sanitary fixture 44 by pivoting the screw 21 about its axis so to cause the pin 23 and thus the fixing member 22 to move along the threaded stem of the threaded screw 21.

The fixing member 22 is preferably U-shaped in cross section. It is hinged to the pin 23 with the facing legs of the U-shaped cross section. Further, the fixing member 22 has an opening 20*a,* for allowing the passage of the threaded stem of the threaded screw 21. With the pin 23 proximate to the free end of the threaded stem of the threaded screw 21, the fixing member 22 can be rotated about pin 23 until the longitudinal axis of the fixing means 22 presents a minimum bulk so that it may pass through hole 3, as shown in FIG. 2.

Suitably, an elastic means is provided which elastically opposes the displacement of the fixing member 22 from the blocking position 22' to the insertion position. Said elastic means preferably consists of a pair of pads 31, 32 capable of being elastically deformed, which are housed between the facing legs of the U-shaped cross section in the fixing member 22. As a result of their elastic reaction, said pads 31, 32 automatically return the fixing member 22 to the blocking position 22'. In practice, when the fixing member 22 is manually returned to the insertion position, depending on the direction it is rotated, either of the pair of elastic pads 31, 32 is elastically deformed by the threaded screw 21 and allows the fixing member 22 to accommodate the threaded screw 21. When the fixing member 22 is released, the elastically deformed elastic pads 31, 32 returns the fixing member 22 to the blocking position 22' position The head 21*a* of the threaded screw 21 is suitably provided with engagement areas consisting of a recessed hexagonal seat 21*c*. Alternately, the engagement area could consist of a transverse cut, which can be engaged by an operating tool, such as a screw driver, to rotate the threaded screw 21 about its axis.

The block portion 2 has a further rod passage hole 25 engageable by a drain controlling rod 26 for controlling a drain cap (not shown), for closing a drain pipe (not shown) of the sanitary fixture 4.

In operation, the device functions as follows: The water intake ducts 10 and 11 are preliminarily connected to block portion 2. After the faucet apparatus 5 is installed, water intake ducts 10 and 11 are connected to the water mains. The pin 23 is coupled to the threaded screw 21 after threaded screw 21 is inserted through the attachment hole 27 in block portion 2, as shown in FIG. 1. The fixing member 22 is manually rotated and held parallel to threaded screw 21, and then inserted through the through hole 3. During insertion, the fixing member 22 is held against the threaded screw 21 until fixing member 22 clears hole 3.

Once the insertion through hole 3 is complete, the fixing member 22 is free and rotates with respect to the pin 23 and goes to the blocking position 22'as a result of the elastic reaction of either pad 31 or pad 32 that have been compressed. Next, the threaded screw 21 is rotated so as to cause the pin 23 to increasingly ride up until the fixing member 22 engages the lower face 4*b* of the sanitary fixture 4, thus enabling the tightening of the block portion 2 onto the sanitary fixture 4.

In the next step, the faucet body 5 is placed on the block portion 2, thus engaging the mouths of the intake water ducts 10 and 11 with the supply fittings 12 and 13. The faucet apparatus 5 is then mounted by means of a threaded set screw 29 that engages a recessed shoulder 30 on body portion 2 adapted for that purpose on an intermediate portion thereof. The block portion provides means for fixing 28, see FIG. 4, preferably blind holes for fixing the set screw 29 into on the recessed shoulder 30, so that the dispensing portion 5 may be selectively fixed at any one of a plurality of selected angles relative to the block portion. This is possible since the block portion 2 is round and the faucet portion 5 may be set at any angle relative thereto. Such set screw holes are required so as to prevent the two portions 4 and 5 from changing their relative positions. Therefore, the faucet can be mounted to the sanitary fixture 4 strictly from above the sanitary fixture 4 and, indeed, may be positioned at a selected fixed angle as described.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A faucet apparatus comprising:

a block portion enabled for being inserted into a through hole in a sanitary fixture and adapted to protrude with a portion thereof above said sanitary fixture, a plurality of passages extending through said block portion, the passages enabled for connection, below said sanitary fixture, to water intake ducts, and above said sanitary fixture to a dispensing portion of the faucet apparatus, the portion of the block portion protruding above the sanitary fixture being able to be housed within a body of the dispensing portion of the faucet apparatus and removably fixed thereto;

an attachment means for fixing said block portion to the sanitary fixture, said attachment means having at least a portion that extends through one of said plurality of passages, said attachment means comprising a fixing member movable from an insertion position, in which said fixing member is aligned with an axis of the through hole in the sanitary fixture, so as to pass easily through said through hole, to a blocking position in which said fixing member is laid transversely across said through hole so as to engage a lower surface of the sanitary fixture.

2. The apparatus according to claim 1, wherein said block has a substantially cylindrical shape for being coupled coaxially with said through hole, said passages being oriented generally parallel to the axis of said block portion.

3. The apparatus according to claim 2, wherein said attachment means comprises a screw enabled for being inserted through a block hole extending axially through said block portion, said screw engaging a threaded hole made through a pin having a pin axis oriented transverse to the axis of said block portion, said attachment means being hinged to said pin and rotatable with respect to said pin about the pin axis for passing from said insertion position to said blocking position.

4. The apparatus according to 3, wherein said fixing member comprises an elongated plate having a U-shaped cross section, said plate being hinged about two facing legs of the fixing member to said pin and having an opening for allowing the passage of said screw.

5. The apparatus according claim 4, wherein said plate, with said fixing member being in said insertion position, houses a portion of a stem of said screw between the two facing legs.

6. The apparatus according to claim 5, wherein said screw has a head provided with engaging areas for an operating tool, said screw head being fully housed in an upper part of the hole of said block portion.

7. The apparatus according to claim 6, wherein an elastic means is adapted for elastically counteracting the passage of said fixing member from said blocking position to said insertion position.

8. The apparatus according to claim 7, wherein the elastic means comprises a deformable pad housed within said plate and compressible by said screw upon the rotation of said fixing member in passing from said blocking position to said insertion position.

9. The apparatus according to claim 8, wherein said block portion further provides a rod passage hole for the passage of a drain controlling rod.

10. The apparatus according to claim 1, wherein the block portion provides means for fixing the dispensing portion at a plurality of selected angles relative to the block portion.

* * * * *